US005768811A

United States Patent [19]

Cooper

[11] Patent Number: 5,768,811

[45] Date of Patent: Jun. 23, 1998

[54] SYSTEM AND PROCESS FOR CONTROLLING AN EXCAVATION IMPLEMENT

[75] Inventor: Mark Cooper, Pella, Iowa

[73] Assignee: Vermeer Manufacturing Company, Pella, Iowa

[21] Appl. No.: 801,369

[22] Filed: Feb. 19, 1997

[51] Int. Cl.[6] ..... E02F 9/24

[52] U.S. Cl. ..... 37/348; 172/2; 364/424.07

[58] Field of Search ..... 37/348, 350; 172/4, 172/4.5, 7, 9, 11; 414/694, 699; 364/424.07

[56] References Cited

U.S. PATENT DOCUMENTS

| | | | |
|---|---|---|---|
| 4,255,883 | 3/1981 | Ealy . | |
| 4,322,899 | 4/1982 | Clune . | |
| 5,065,326 | 11/1991 | Sahm . | |
| 5,426,874 | 6/1995 | Nakata et al. | 37/348 |
| 5,438,771 | 8/1995 | Sham et al. . | |
| 5,442,868 | 8/1995 | Ahn . | |
| 5,544,055 | 8/1996 | Cooper . | |
| 5,553,407 | 9/1996 | Stump | 37/348 |
| 5,559,725 | 9/1996 | Nielson et al. | 37/348 X |
| 5,598,648 | 2/1997 | Moriya et al. | 37/348 |

*Primary Examiner*—Michael J. Carone
*Assistant Examiner*—Robert Pezzuto
*Attorney, Agent, or Firm*—Merchant, Gould, Smith, Edell, Welter & Schmidt, P.A.

[57] ABSTRACT

A system and process for controlling an excavation implement during excavation between an above-ground position and a below-ground position. The excavation implement is actuated by use of the engine operating at a target output level. A computer controls the rate at which the excavation implement is moved in a generally vertical direction while excavating earth between the above-ground and below-ground positions. A sensor senses a performance parameter indicative of either engine performance or excavation implement performance as the excavation implement progresses through the earth. The computer modifies actuation of the excavation implement in response to the sensed performance parameter to maintain the engine at the target output level when the engine is subject to variations in loading as the excavation implement moves between the above-ground and below-ground positions.

17 Claims, 14 Drawing Sheets

SYSTEM AND PROCESS FOR CONTROLLING AN EXCAVATION IMPLEMENT

FIELD OF THE INVENTION

The present invention relates generally to the field of excavation and, more particularly, to a system and process for controlling an excavation implement during excavation.

BACKGROUND OF THE INVENTION

Various types of excavation machinery initiate an excavation operation at an above-ground position and employ a powered excavation tool to penetrate the earth to a specified depth. Certain excavation machines are designed to initially excavate earth in a generally vertical direction with respect to the ground surface, and then proceed with excavation in a generally horizontal direction. For these and other excavation machines, the time required to complete the initial vertical excavation effort is typically appreciable. Also, such machines typically require a highly experienced operator to properly control the vertical excavation operation in an effort to maximize excavation efficiency.

One such excavation machine that performs an initial vertical excavation prior to a horizontal excavation is termed a track trencher. A track trencher excavation machine, such as that illustrated in FIGS. 1 and 2, typically includes an engine 36 coupled to a right track drive 34 and a left track drive 32 which together comprise the tractor portion 45 of the track trencher 30. An attachment 46, usually coupled to the back of the tractor portion 45, typically performs a specific type of excavating operation.

A ditcher chain 50 is often employed to dig relatively large trenches at an appreciable rate. The ditcher chain 50 generally remains above the ground in a transport configuration 56 when maneuvering the trencher 30 around the work site. During excavation, the ditcher chain 50 is lowered, penetrates the ground, and excavates a trench at the desired depth and speed while in a trenching configuration 58. Another popular trenching attachment is termed a rock wheel in the art, shown in FIG. 3, and may be controlled in a manner similar to that of the ditcher chain 50.

Controlling a track trencher 30 using a prior art control scheme during an initial vertical excavation operation, often referred to as a plunge operation, generally requires an operator to manipulate various levers, switches, and knobs in order to perform the plunge operation both safely and efficiently. A high degree of skill is typically required on the part of the operator who must continuously monitor and adjust the controls of the tractor portion 45, including the engine 36, as well as the operation of the excavation attachment 46. Maintaining optimum excavation performance during the initial plunge operation using prior art manual controls is generally considered an exacting and fatiguing task.

It is considered desirable to maintain the engine 36 at a constant, optimum output level during excavation which, in turn, allows the excavation attachment 46 to operate at an optimum excavation output level. The control panels shown in FIGS. 4 and 5 include a plurality of conventional controls and switches which are typically adjusted during, for example, the plunge operation in order to maintain the engine at the desired engine output level in the presence of continuously varying levels of attachment 416 loading. The operator must generally react quickly to such changes in engine 36 loading, typically by first determining the appropriate switch to adjust, and then the degree of switch adjustment. It can be appreciated that such a manual approach to controlling an excavation machine, such as a track trencher 30, during a plunge operation often results in over-stressing the excavation implement, the engine, and the operator, as well as reducing overall excavation efficiency.

There is a desire among the manufacturers of excavation machinery to minimize the difficulty of operating such machines in an excavation mode and, more particularly, during a plunge operation. There exists a further desire to reduce the substantial amount of time currently required to perform a plunge operation. The present invention fulfills these and other needs.

SUMMARY OF THE INVENTION

The present invention is directed to a system and method for controlling an excavation implement during excavation between an above-ground position and a below-ground position. The excavation implement is coupled to an excavation machine having an engine, and is actuated by use of the engine operating at a target output level. A computer controls the rate at which the excavation implement is moved in a generally vertical direction while excavating earth between the above-ground and below-ground positions.

A sensor senses a performance parameter indicative of either engine performance or excavation implement performance as the excavation implement progresses through the earth. The computer modifies actuation of the excavation implement in response to the sensed performance parameter so as to maintain the engine at the target output level when the engine is subject to variations in loading as the excavation implement is moved between the above-ground and below-ground positions.

In accordance with one embodiment, a track trencher excavation machine includes a boom pivotally mounted to the excavation machine and supporting an endless digging chain. A cylinder, coupled to the excavation machine and the boom, moves the boom between an above-ground position and a below-ground position during excavation. A controllable valve, responsive to control signals received from a computer or other control device, regulates displacement of the cylinder to modify the rate of boom movement. The computer or control device, coupled to the engine and the controllable valve, controls the controllable valve so as to modify the rate of boom movement in order to maintain the engine at a target output level as the boom is moved between the above-ground and below-ground positions during excavation.

DETAILED DESCRIPTION OF THE VARIOUS EMBODIMENTS

The present invention is directed to a system and method for controlling an excavation implement of an excavation machine while excavating earth between an above-ground position and below-ground position. The control system and method modifies, without requiring operator intervention, actuation of the excavation implement while excavating earth between the above-ground and below-ground positions so as to maintain the engine powering the excavation implement at a target operating level in response to variations in engine loading during the excavation operation.

Figure 6:
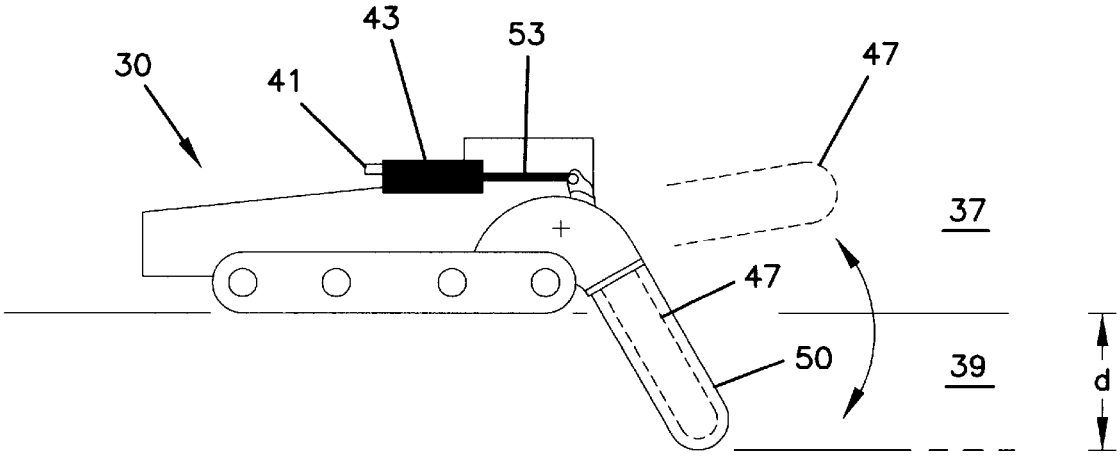
FIG. 6 is an illustration of a track trencher depicted in a below-ground orientation upon completion of a plunge operation, the boom of the excavation attachment being shown in phantom at an above-ground orientation prior to performing the plunge operation.

Referring now to FIG. 6, there is illustrated a depiction of a track trencher excavation machine 30 which includes a boom 47 pivotally mounted to a tractor portion of the track trencher 30. The boom 47, upon which an endless digging chain 50 is supported, is moved between above-ground and below-ground positions 37 and 39, respectively, by actuation of a hydraulic cylinder 43 mounted to the boom 47 and the tractor portion of the track trencher 30. The cylinder 43 includes a shaft 53 which is mechanically coupled to the boom 47. Also coupled to the cylinder 43 is a controllable valve 41 which regulates the flow of hydraulic fluid to the cylinder 43 in response to valve control signals produced by a computer, as will be described in greater detail hereinbelow.

In accordance with the embodiment illustrated in FIG. 6, the track trencher 30 is initially positioned at a desired excavation location, with the boom 47 raised in an above-ground orientation 37. A typical excavation effort involves two excavation operations. The first operation, termed a plunge operation, involves cutting or otherwise removing earth between ground level and a below-ground excavation level, indicated as a depth d. A typical trench depth, d, ranges between approximately two feet to twenty feet for a track trencher of the type illustrated in FIG. 6. After completion of the plunge operation with the boom 47 penetrating the earth to the desired excavation depth, d, the second excavation operation is initiated, termed the trenching operation. A typical trenching procedure involves maintaining the boom 47 at the excavation depth, d, and propelling the tractor and attachment portions of the track trencher 30 in a desired direction, thereby cutting a trench from the initial plunge location to a desired end of trench location.

It is not uncommon for a plunge operation to take between 30 and 60 minutes to complete, depending on the soil characteristics of a particular excavation site and the depth of the initial excavation. During a typical plunge operation using conventional techniques, an operator must continuously monitor and manipulate various controls of a conventional track trencher in order to modify the rate at which the boom 47 is lowered into the ground. Continuous manual modification of boom movement is necessary using conventional control approaches in order to maintain the engine, which provides source power for actuating the boom 47 and digging chain 50, at an optimum output level. Performing a plunge operation in soil having varying geophysical characteristics will produce concomitant variations in excavation difficulty as the activated digging chain 50 and the boom 47 are moved from the above-ground position 37 to the excavation depth, d. Continuous monitoring of various excavation parameters by the operator of a conventional track trencher is typically required to maintain optimum engine output during the plunge operation. It can be appreciated that the tasks of monitoring and modifying excavator performance during the plunge operation for a duration of time on the order of 30 to 60 minutes can be fatiguing.

A system and control process in accordance with the principles of the present invention obviates is the need for an operator to perform such monitoring and modifying tasks during the plunge operation. Moreover, operator latency in reacting to changes in engine loading during a plunge operation, which often results in overshooting or undershooting optimum engine control settings, is also obviated. Other advantages realized by implementing a system and control methodology in accordance with the principles of the present invention include a reduction in the time required to perform plunge operations, reduced engine 36 and digging chain 50 fatigue, and a reduction in the level of skill required on the part of an operator to efficiently and safely operate an excavator during a plunge operation.

Figure 7:
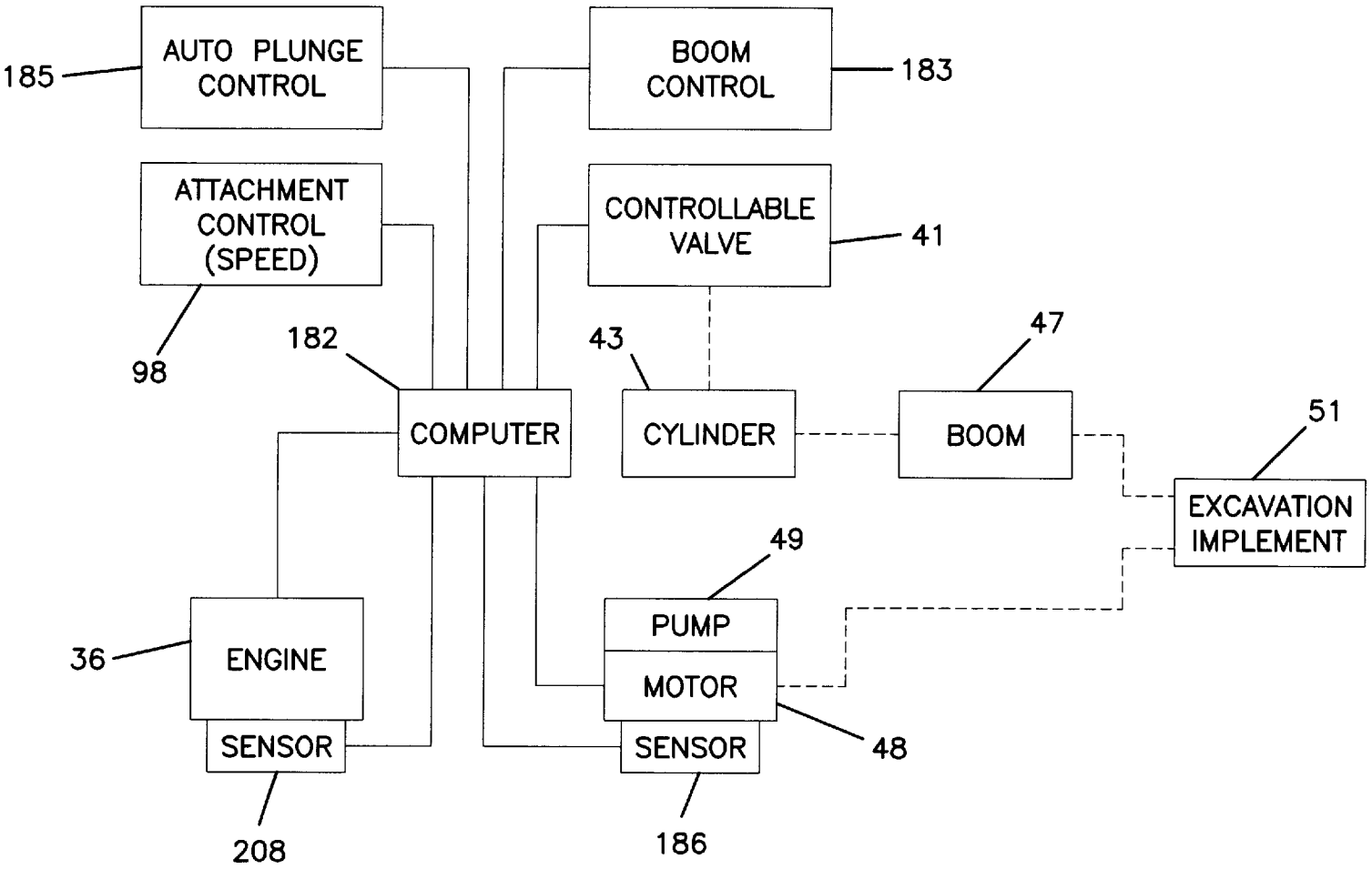
FIG. 7 is a block diagram of a system for controlling an excavation implement during a plunge operation in accordance with the principles of the present invention.

Turning now to FIG. 7, there is illustrated in system block diagram form an embodiment of a system for controlling an excavation attachment during a plunge operation. It is to be understood that a plunge operation refers generally to an operation involving excavation of earth from an initial ground level position to a desired below-ground position. It can be appreciated, however, that the system and methodology for controlling an excavation implement in accordance with the principles of the present invention can advantageously be employed for a variety of excavation machines when performing traditional excavation operations.

Figure 1:
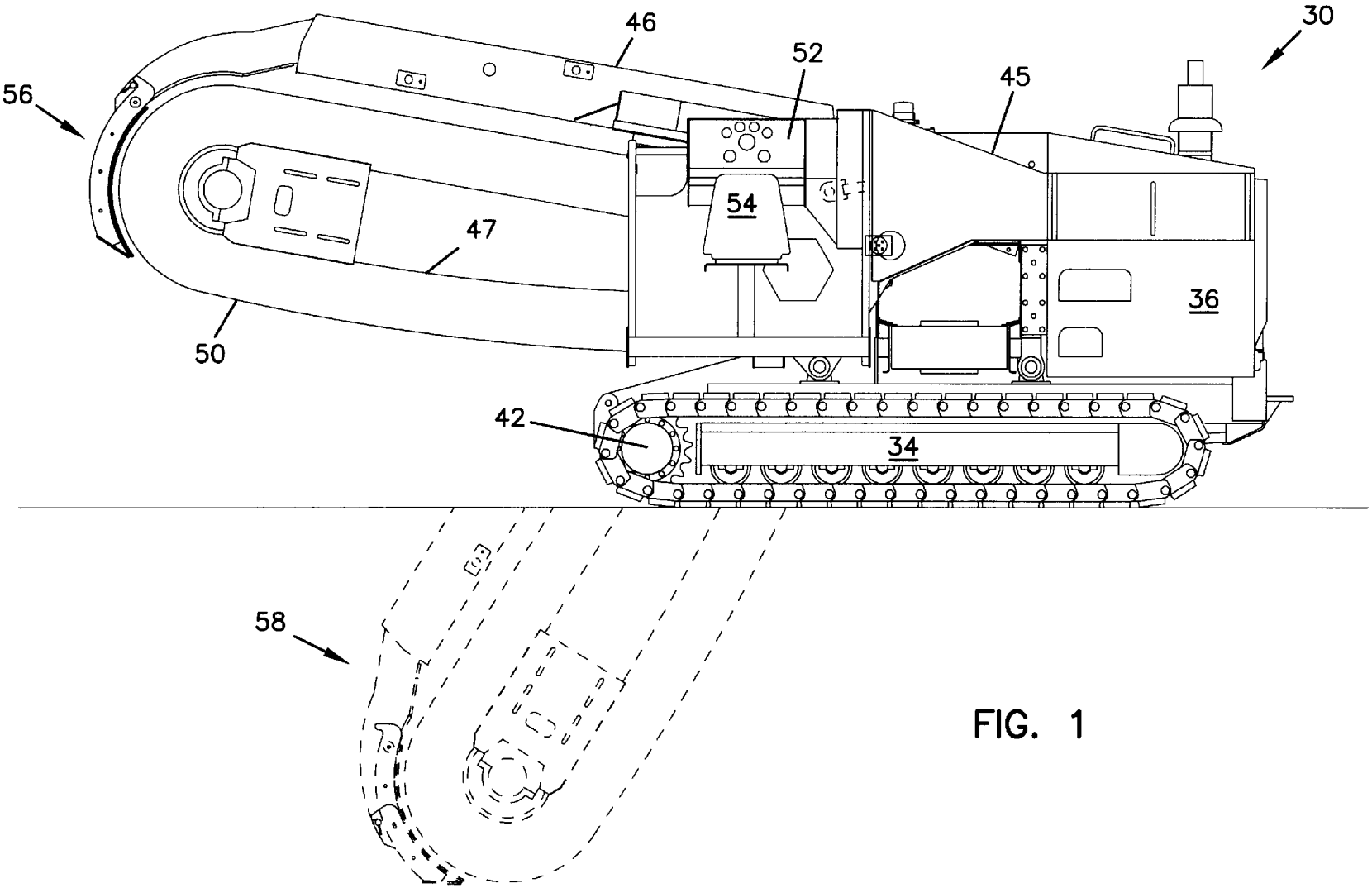
FIG. 1 is a side view of a track trencher excavation machine, including a ditcher chain trenching attachment.
Figure 2:
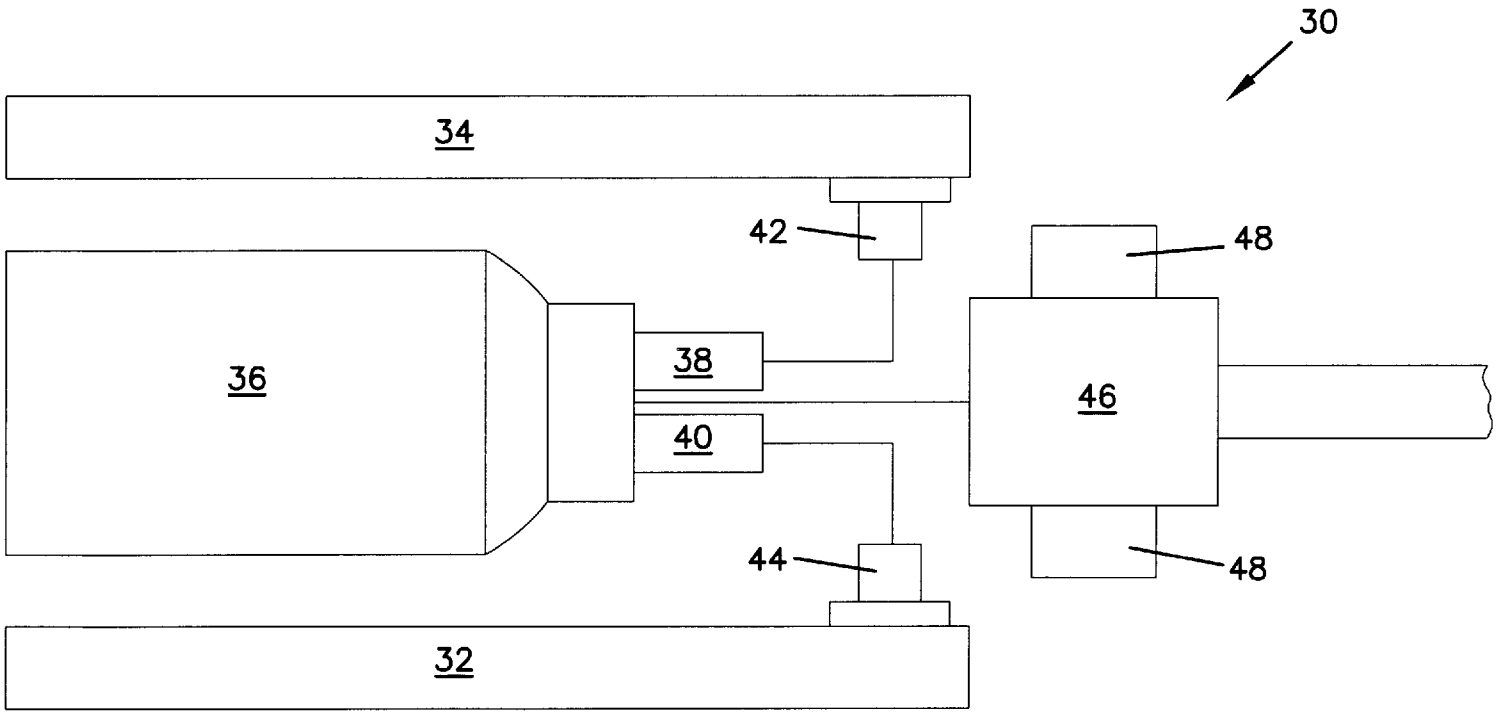
FIG. 2 is a generalized top view of a track trencher.
Figure 3:
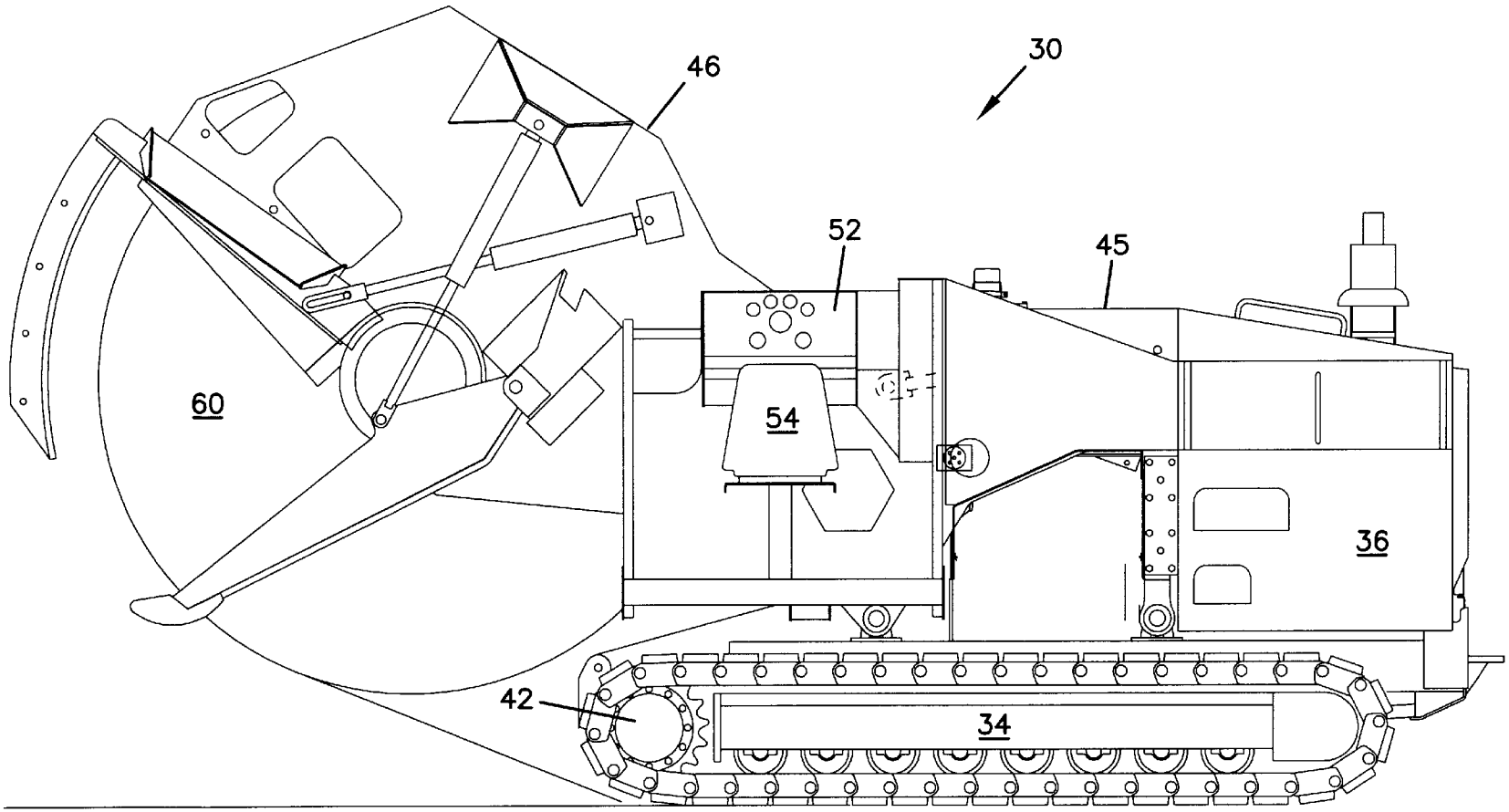
FIG. 3 is a side view of a track trencher with a rock wheel trenching attachment coupled thereto.
Figure 4:
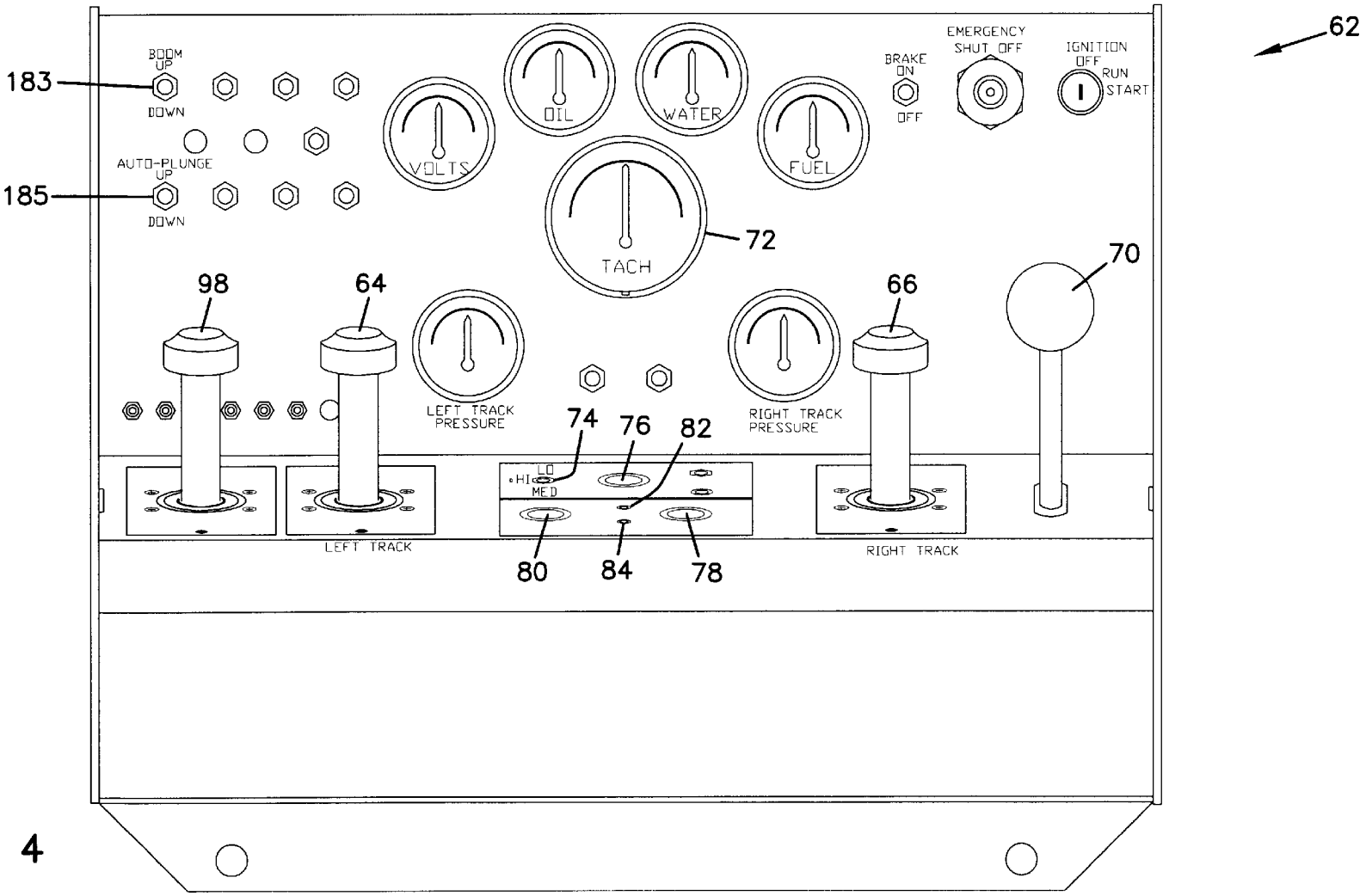
FIG. 4 is an illustration of a typical control panel for controlling a track trencher.
Figure 5:
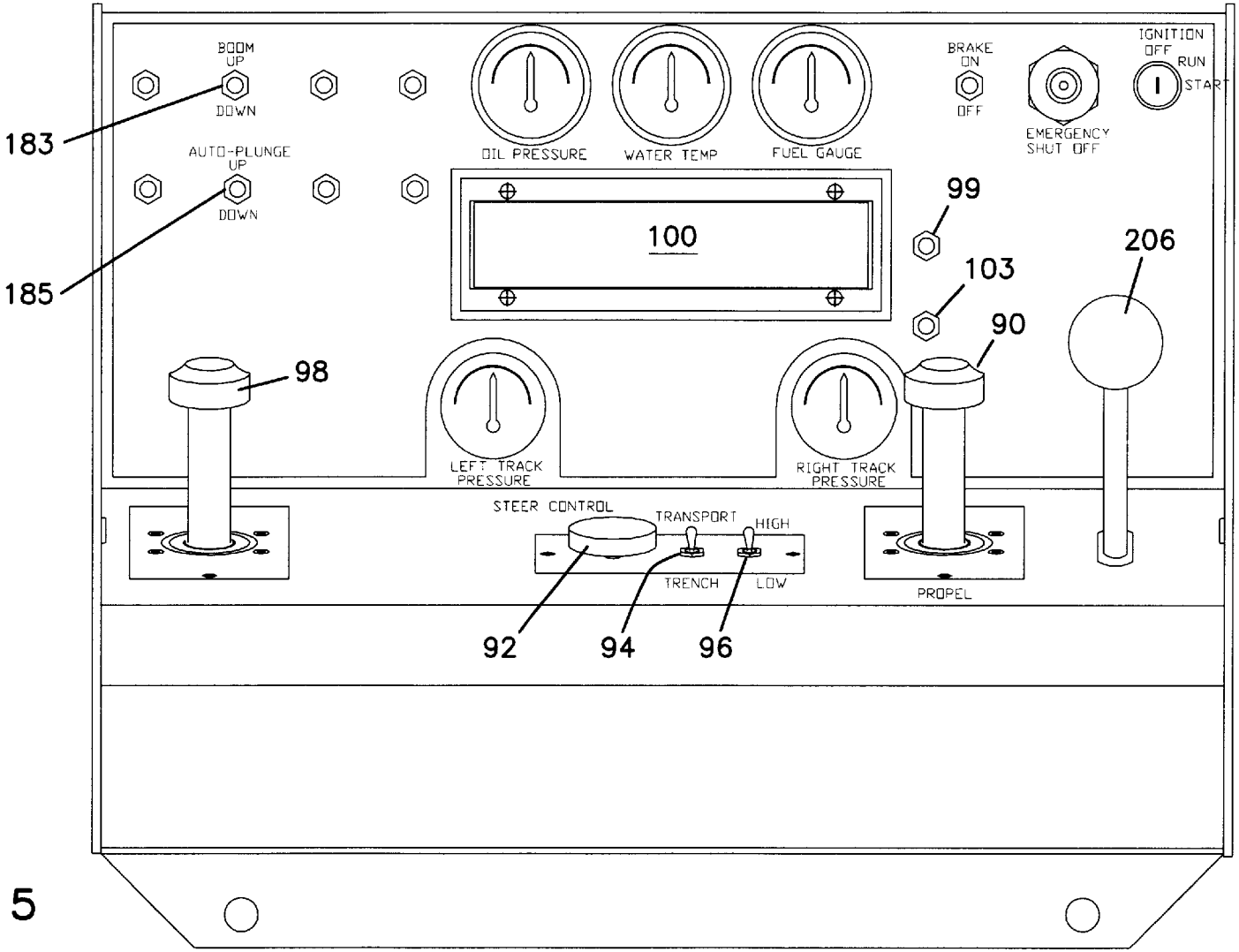
FIG. 5 is a view of a control panel incorporating a multiple mode propel control, a multiple mode steering control, and a display.

In the embodiment illustrated in FIG. 7, an excavation implement 51 is mechanically coupled to a boom 47 which, in turn, is mechanically coupled to a cylinder 43. It is noted that the dashed lines in FIG. 7 represent mechanical coupling, and unbroken continuous lines represent electrical or electronic connectivity. A controllable valve 41 regulates the displacement of the cylinder 43 and, therefore, controls the displacement of the boom 47 and excavation implement 51. Also mechanically coupled to the excavation implement 51 is a motor 48 which drives the digging chain 50, shown in FIGS. 1 and 6, or other excavating tool. The motor 48 is typically a hydraulic motor driven by a pump 49 which is powered by the engine 36.

As is further shown in the embodiment illustrated in FIG. 7, a computer 182 is coupled to the controllable valve 41, the motor 48, the engine 36, and an attachment speed control 98 typically provided on the operator control panel. A sensor 208 is coupled to the engine 36 to sense one of a number of engine operating parameters. The sensor 208, by way of example, may include a magnetic pulse pickup (PPU) that transduces engine rotation into a continuous series of pulse signals indicative of the frequency of engine rotation as measured in revolutions-per-minute (RPM). Other known sensors for transducing engine performance may also be employed.

In accordance with one embodiment, the computer 182 receives a signal from the sensor 208 indicative of engine performance during a plunge operation. The computer 182 initiates the plunge operation by transmitting a control signal to the controllable valve 41 causing the cylinder 43 to exert a force on the boom 47 such that the boom 47 pivots and the excavation implement 51 penetrates the earth. The frictional and resistive forces exerted on the excavation implement 51 upon penetrating the earth results in loading of the motor 48 and the engine 36 which powers the pump 49 that drives the motor 48.

The computer 182, in response to changes in engine 36 loading, transmits a control signal to the controllable valve 41 to modify the rate of boom 47 movement so as to maintain the engine 36 at a target output level. In this manner, the control system illustrated in FIG. 7 may be employed to maximize excavation productivity by moderating movement of the excavation implement 51 in response to engine 36 loading.

Figure 10:
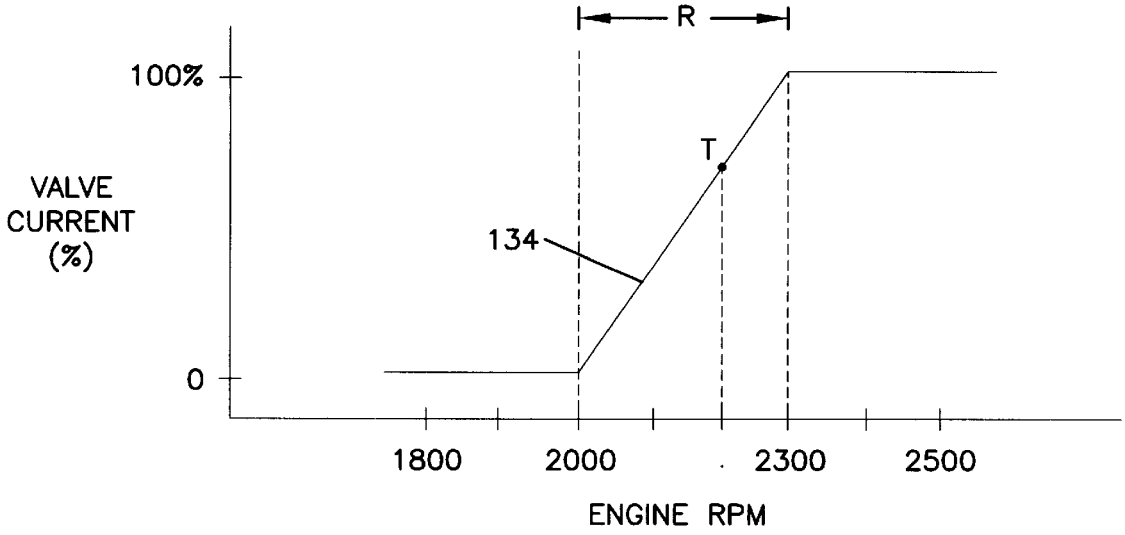
FIGS. 10 and 11 illustrate engine load line diagrams associated with two different embodiments of a controllable valve.
Figure 11:
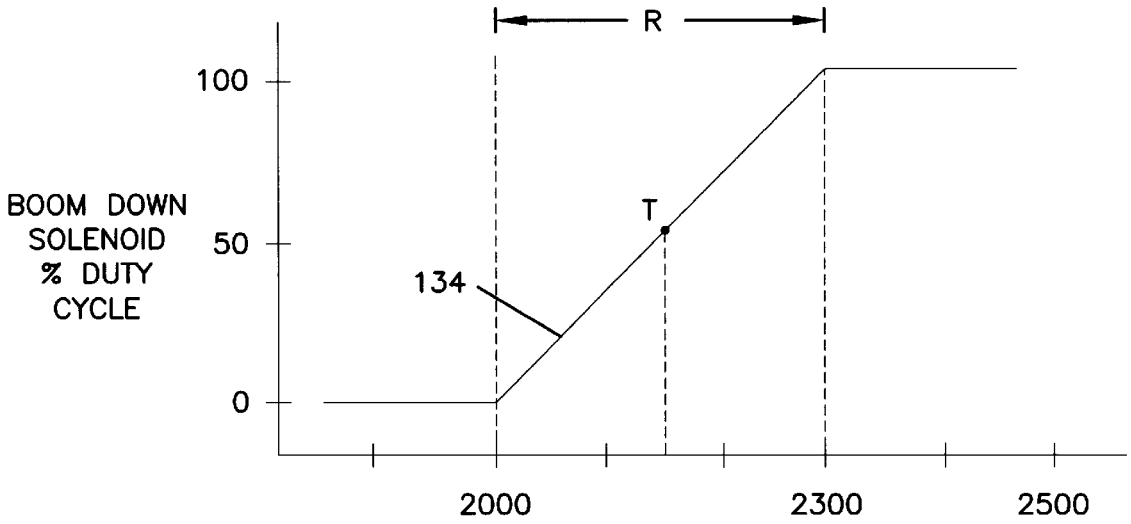

A preferred target engine output level is generally associated with a speed at which the engine 36 produces maximum horsepower, although other engine output levels may be appropriate. Depending upon the particular characteristics of the engine 36, the range of optimum engine speeds will differ. An example of a typical range of productive target engine output levels for an excavation machine, such as a track trencher 30, is illustrated in FIGS. 10 and 11. An engine load line 134 represents a working range (R) of productive engine output levels associated with a particular engine of an excavation machine.

The engine load line 134 illustrated in FIG. 10, for example, represents a relationship between the percentage of control current supplied to the controllable valve 41 and engine output measured in RPM. An electronic representation of this relationship is used by the computer 182 to maintain the engine 36 at the target engine RPM. As is illustrated in FIG. 10, a target engine RPM of 2,200 RPM is depicted falling within a working engine RPM range (R) of 300 RPM. It is noted that the bandwidth or range (R) of working engine RPM values may be varied in magnitude, and may also be translated along the engine RPM axis. In addition, the target engine output point, T, may be adjusted within the range (R) as desired. The engine load line 134 illustrated in FIG. 11, in accordance with another embodiment, illustrates a relationship between the duty cycle of a solenoid-type controllable valve 41 and engine output measured in RPM which is used by the computer 182 to maintain the desired target engine output level.

As previously mentioned, it is generally desirable to maintain the engine 36 at a constant optimum output level during excavation which allows the excavation implement 51 to operate at an optimum excavation output level. By way of example, and with reference to FIG. 10, a desired engine target output level may be established as 2,200 RPM. The target engine output level may be determined for a particular engine 36 at the time of manufacture, or may be subsequently determined in the field in a manner described in U.S. Pat. No. 5,544,055, which is assigned to the assignee of the instant application, the contents of which is incorporated herein by reference. The target engine output level is stored in non-volatile memory in the computer 182.

During a plunge operation, the computer 182 or other control device, such as a load controller, communicates control signals to the controllable valve 41 to maintain the engine 36 at the target output level, T, as the excavation implement 51 penetrates the ground under a force exerted on the boom 47 by the cylinder 43. In one embodiment, the controllable valve 41 is responsive to a current control signal produced by the computer 182 or other control device. As is illustrated in FIG. 10, a maximum current control signal (100%) under un-loaded conditions corresponds to an engine output level of 2,200 RPM.

A minimum current control signal (0%) corresponds to an engine output level of 2,000 RPM. As engine 36 loading increases during a plunge operation, the computer 182 transmits an appropriate current control signal to the controllable valve 41 to decrease the rate of boom 47 descent in an effort to offset the engine loading increase. A closed-loop control path between the computer 182, controllable valve 41, engine 36 and engine sensor 208 provides for maintaining the engine 36 at the target output level, T.

In accordance with another embodiment, as illustrated in FIG. 11, the computer 182 transmits a control signal that varies the duty cycle of a solenoid-type controllable valve 41, such as a proportional directional valve. During a plunge operation, the solenoid duty cycle is modified by the computer 182 to regulate the flow of hydraulic fluid through the valve 41, thereby regulating the rate and magnitude of cylinder 43 extension as the boom 47 is moved from the above-ground position to the below-ground position. It can be appreciated that retraction of the boom 47 may, if desired, be similarly controlled. It is to be understood that other controllable valves may be employed to control the cylinder 43, such as an open center valve, a closed center valve, a load sense valve, or a proportional directional valve, for example. It is further understood that actuators different from the cylinder 43 which perform a similar function of controlling boom 47 movement may also be employed, and may be mechanically driven rather than hydraulically driven.

The computer 182, in cooperation with the controllable valve 41 and various controls that modify engine 36 performance, controls the loading of the engine 36 by modifying the rate of boom 47 descent as the excavation implement 51 penetrates the earth during a plunge operation. Various analog and digital devices are known in the art for facilitating precision load control of an engine to maintain the engine at a constant speed under varying load conditions. One such analog load controller is Model MCE101C Load Controller manufactured by Sauer Sundstrand. A suitable digital device that can be adapted to perform engine load control is Model DC2 Microcontroller, also manufactured by Sauer Sundstrand. Such load control devices may provide the requisite control of a plunge operation in accordance with the principles of the present invention exclusive of, or in cooperation with, a computer 182. By way of example, and not of limitation, an analog or digital load controller may provide the requisite control signals described herein as being produced by the computer 182 illustrated in the Figures.

The engine 36 preferably includes an engine sensor 208 which monitors the speed of the engine 36, and communicates actual engine speed information to the computer 182. Any deviation between the actual and target engine speeds is compensated for by the computer 182 communicating an appropriate control signal to the controllable valve 41 which, in turn, modifies the rate at which the boom 47 and excavation implement 51 descend during the plunge operation.

In accordance with another embodiment, a sensor 186 maybe employed to monitor the speed at which the attachment motor 48 operates during a plunge operation. The sensor 186 may be a PPU or other type of device that senses the speed of the attachment motor 48. Alternatively, or additionally, a sensor unit 186 may be employed which includes a pressure sensor and a flow rate sensor which respectively sense the pressure and flow rate of hydraulic fluid passing through the attachment motor 48. Output signals from the pressure and flow rate sensors may be used by the computer 182 to compute changes in attachment motor 48 horsepower. Loading of the attachment motor 48 during a plunge operation is sensed by the sensor 186 and communicated to the computer 182. In response to changes in attachment motor 48 loading, the computer 182 transmits an appropriate control signal to the controllable valve 41 to moderate the rate of boom 47 descent to maintain the engine 36 at a target output level.

In yet another embodiment, the computer 182 may receive actual engine speed information from the sensor 208 as well as actual attachment motor 48 speed from the sensor 186. Information received by the computer 182 from both the engine sensor 208 and the attachment motor sensor 186 may then be compared to target engine 36 and attachment motor 48 speeds, respectively. In response to the comparison operation, the computer 182 transmits an appropriate control signal to the controllable valve 41 to adjust the rate at which the boom 47 descends into the ground.

Figure 8:
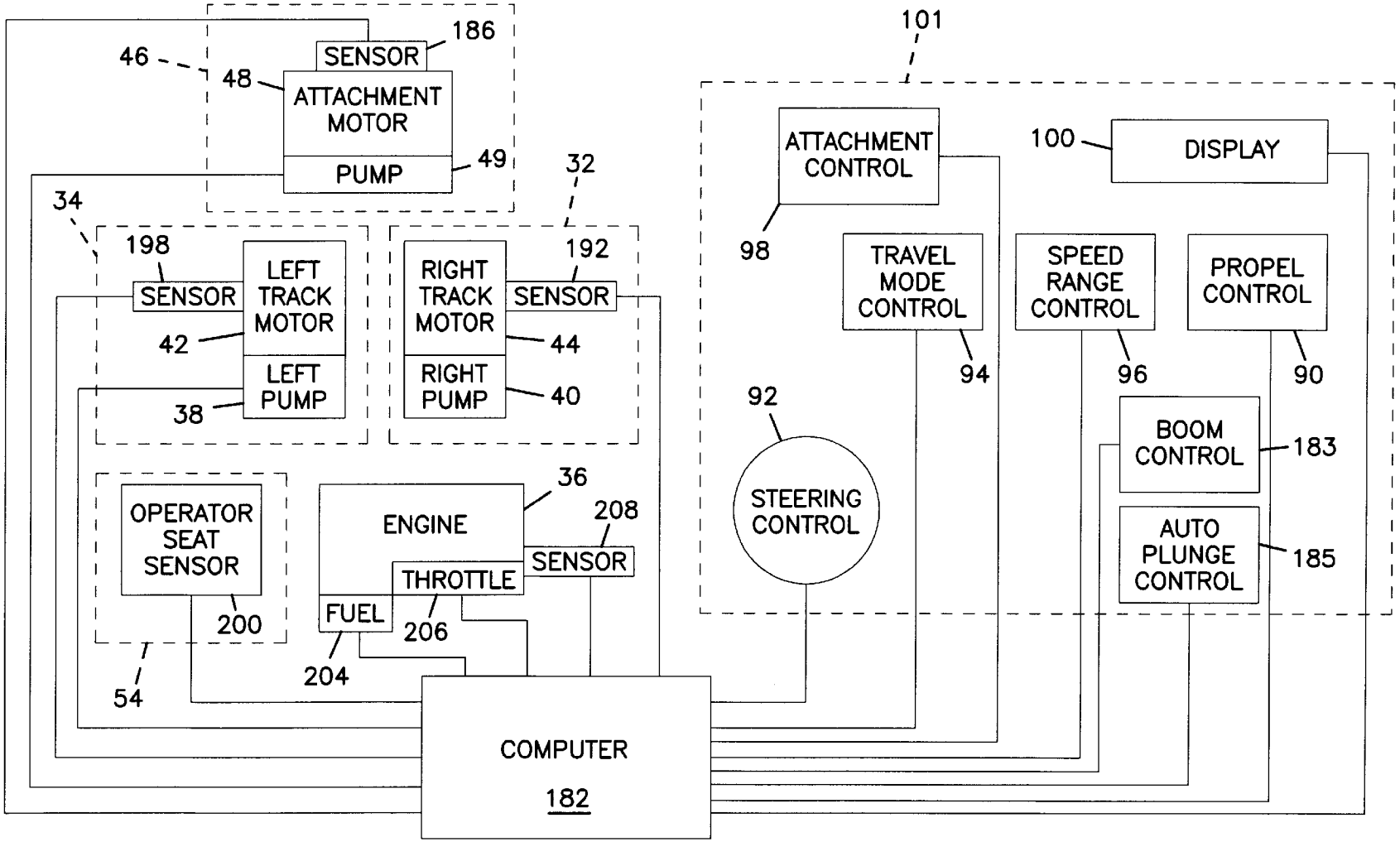
FIG. 8 is a block diagram illustrating a computer-based system for controlling the propulsion and steering of a track trencher employing multiple mode propel and steering controls, and, in particular, for controlling an excavation implement during a plunge operation in accordance with the principles of the present invention.

In FIG. 8, there is illustrated an embodiment of a system for controlling a track trencher excavation machine 30 in which a computer 182 is employed to optimize the performance of the track trencher 30. A control panel 101 includes an attachment speed control 98 which is manipulated by the operator to modify the speed of the attachment 46, which may include an excavation implement 51 of the type previously discussed hereinabove. A display 100, such as a liquid crystal display (LCD), is provided on the control panel 101 to communicate information to the operator concerning the operation of the excavating machine. In one embodiment, the display 100, in cooperation with computer 182, communicates immediately understandable informational messages, such as messages in English, to the operator. During a plunge operation, for example, the display 100 may communicate the message "CHAIN AT 85%." The display 100 may also present engine performance information to the operator, such as the message "ENGINE AT 2200 RPM."

As is further shown in FIG. 8, the computer 182 may control the operation of the engine 36 through use of a throttle 206 and/or a fuel control 204 that regulates fuel to the engine 36. The throttle 206 of the engine 36 may include a throttle sensor which monitors the voltage or other parameter of the throttle control 206. It is to be understood that the system and methodology for controlling the excavation attachment 46 is not limited to implementation in a system such as that illustrated in FIG. 8, but may be employed to optimize excavation efficiency in a variety of excavation machinery.

Figure 9:
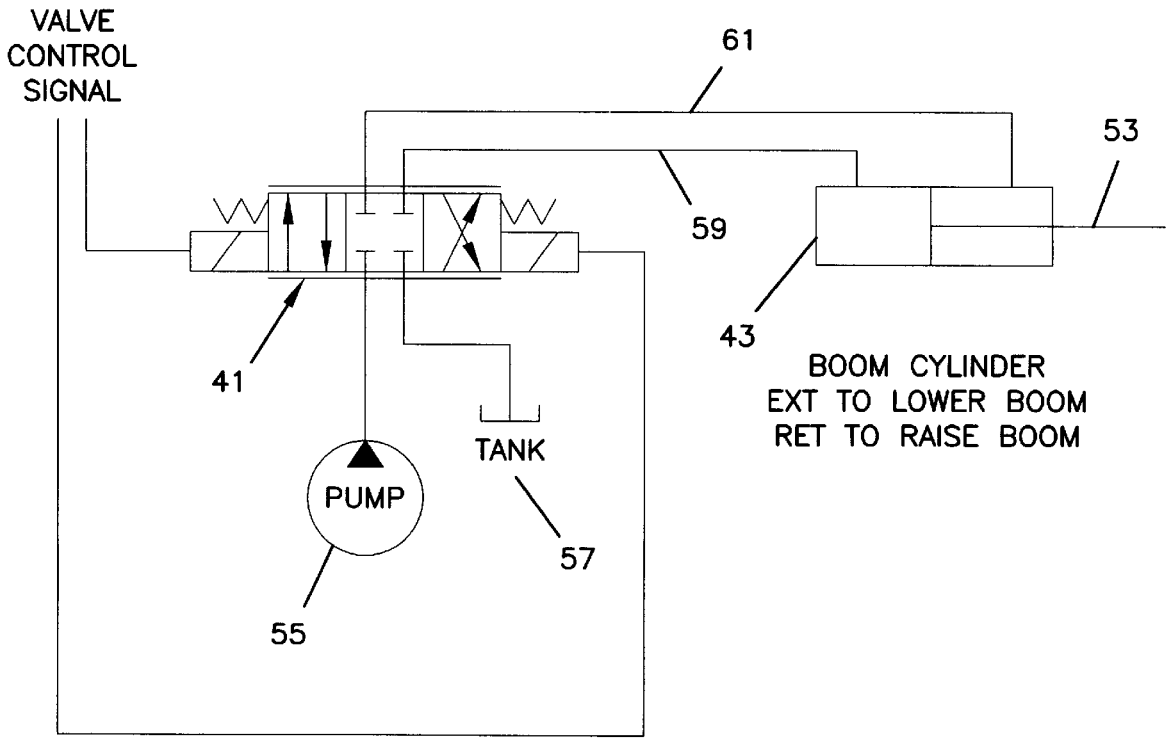
FIG. 9 is a cross-sectional view of an embodiment of a controllable valve for controlling the descent rate of an excavation implement during a plunge operation.

In FIG. 9, there is illustrated an embodiment of a proportional solenoid valve 41 coupled to a boom cylinder 43 by hydraulic lines 61 and 59. The proportional solenoid valve 41, which is responsive to valve control signals produced by the computer 182, such as pulse width modulated (PWM) signals, regulates hydraulic fluid between a supply pump 55, the cylinder 43, and a tank 57. When the computer 182 determines that the descent rate of the boom 47 should be increased, an appropriate valve control signal is communicated the proportional solenoid valve 41 which, in turn, increases the flow of hydraulic fluid supplied by the pump 55 and delivered to the cylinder 43 through hydraulic line 59. In order to raise the boom 47, an appropriate valve control signal causes the proportional solenoid valve 41 to increase the flow of hydraulic fluid supplied by the pump 55 through hydraulic line 61 and allowing return fluid from hydraulic line 59 to be directed to the tank 57.

Figure 12:
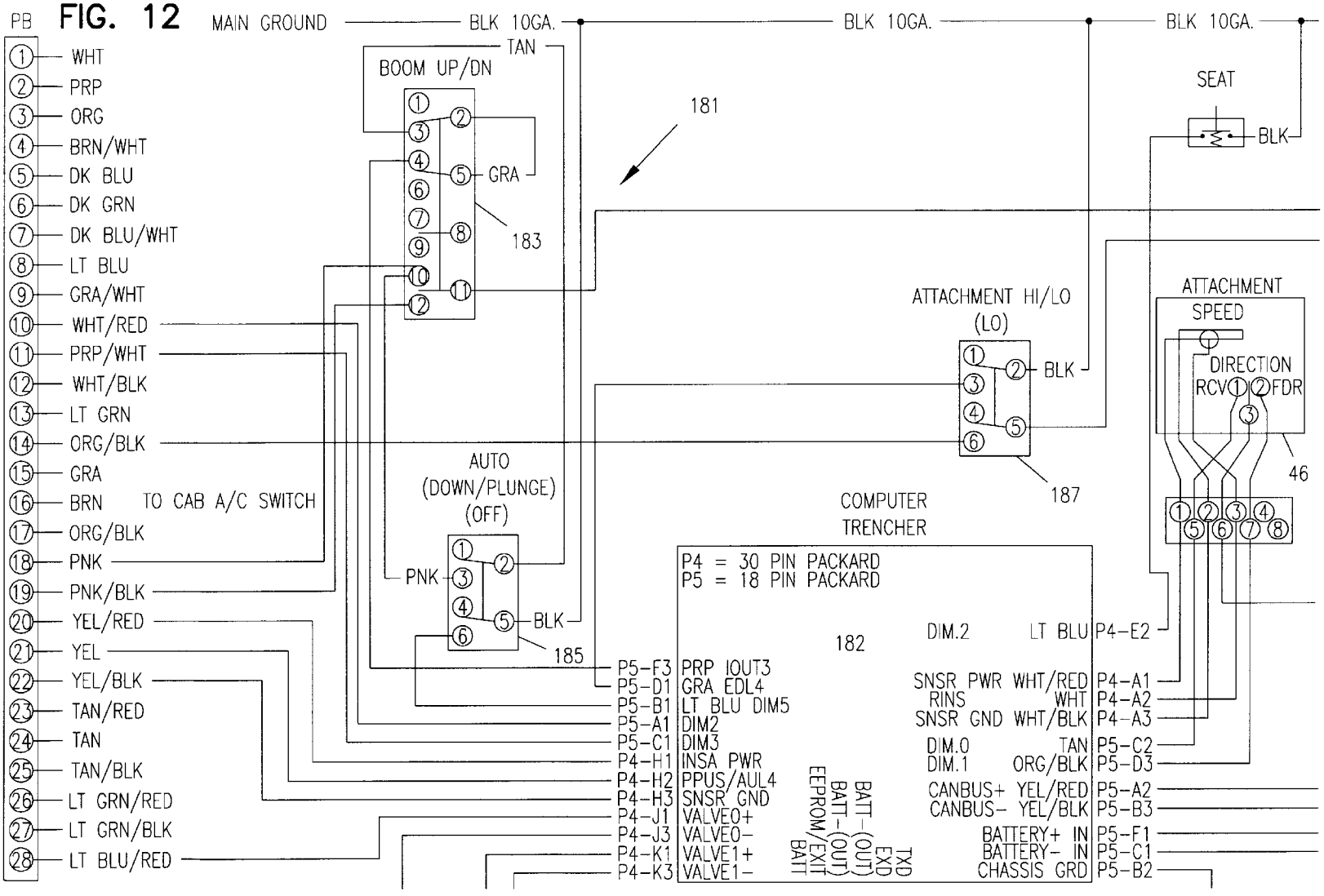
FIGS. 12 and 13 are schematic diagrams illustrating portions of an embodiment of a system for controlling an excavation implement during a plunge operation in accordance with the principles of the present invention.
Figure 13:
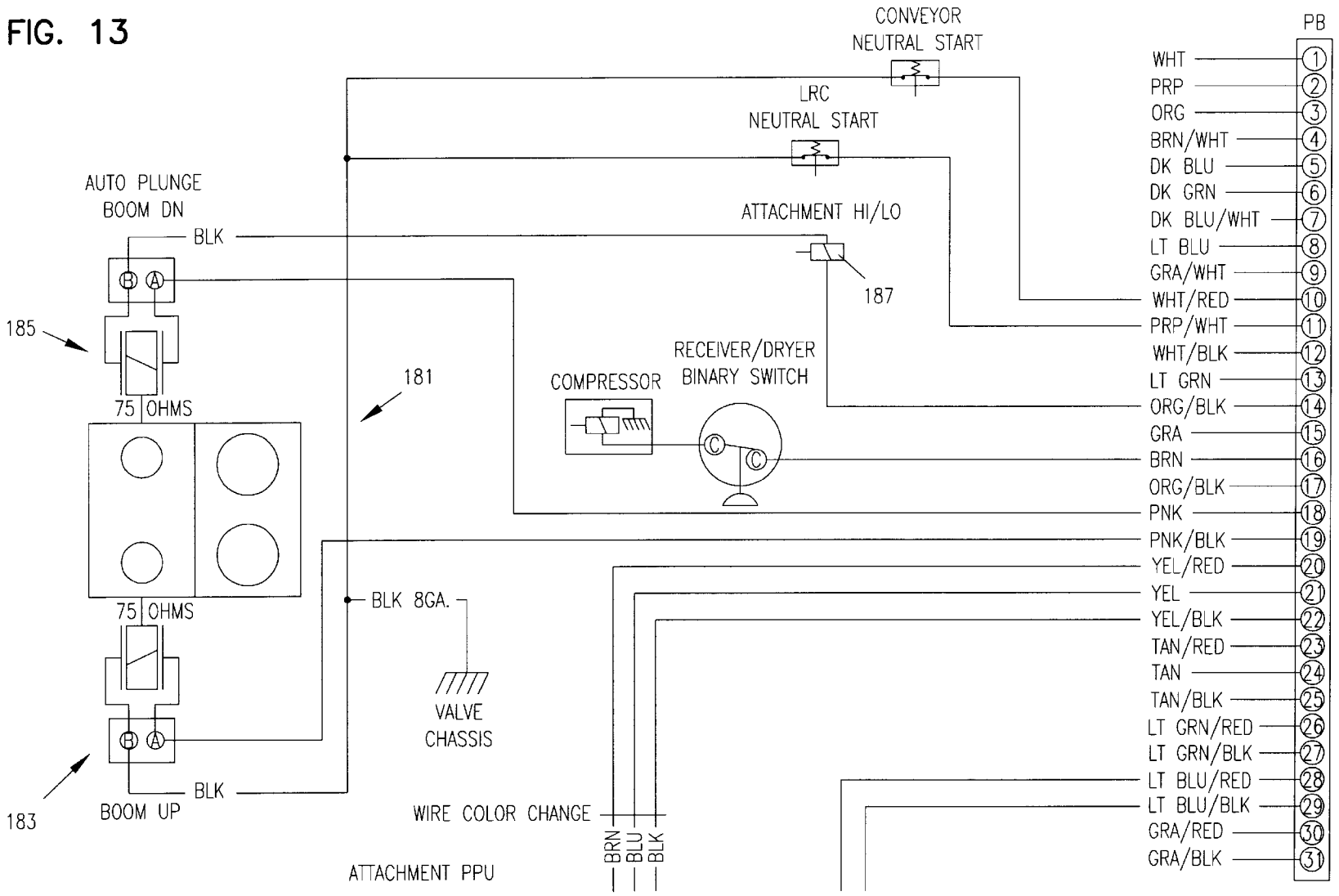
Figure 14:
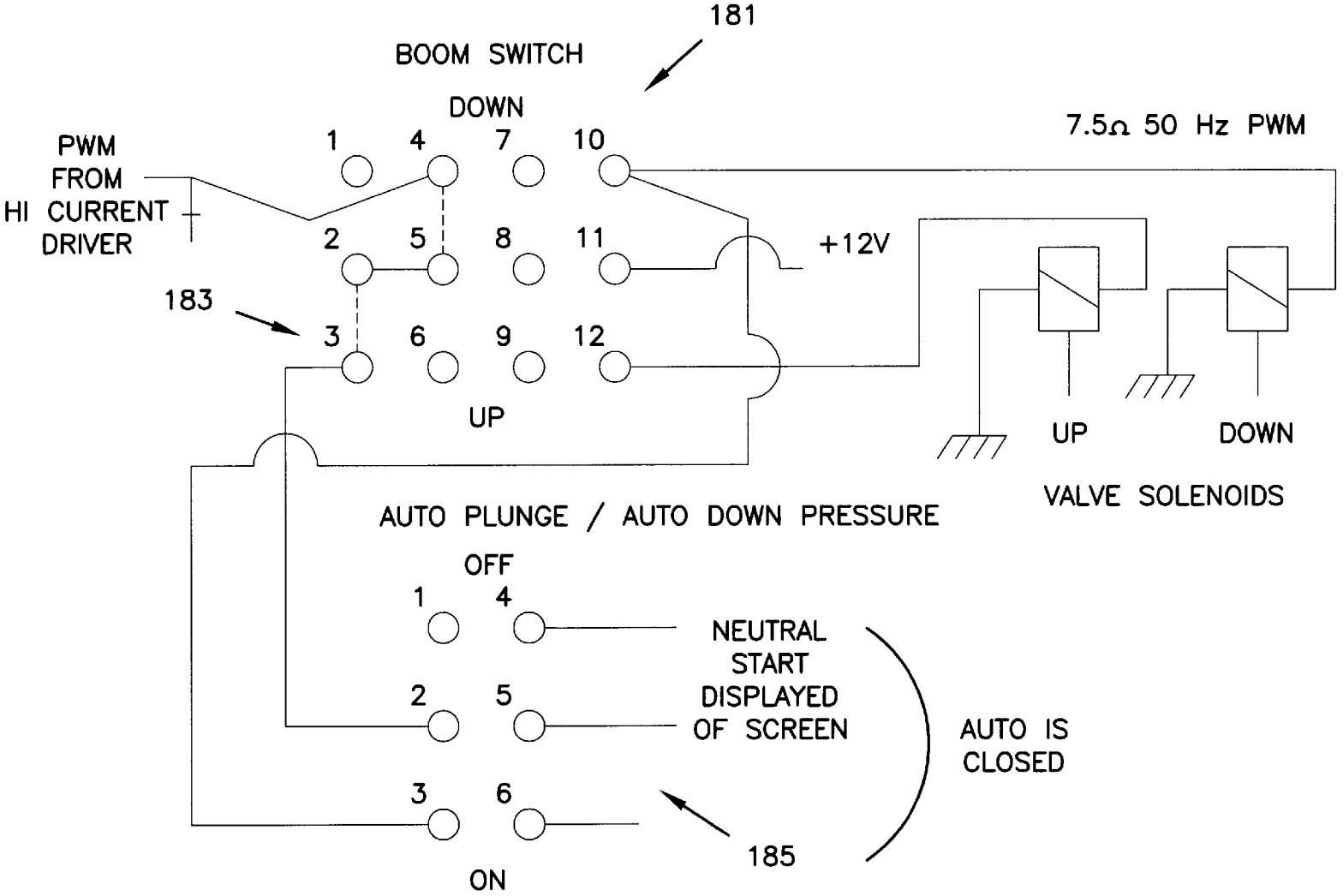
FIG. 14 is a wiring diagram of a switch that controls a boom supporting an excavation implement, the switch being operatively coupled to a controllable valve which regulates movement of a cylinder connected to the boom.

Turning now to FIGS. 12–14, there is illustrated in schematic diagram form an embodiment of a circuitry for controlling the rate of excavation implement descent during a plunge operation. A boom control circuit 181 includes a BOOM UP/DOWN circuit 183 is and an AUTO-PLUNGE ON/OFF circuit 185, both of which are coupled to the computer 182. Control, power, and sensor lines are shown coupling the excavation attachment 46 to the computer 182. A HI/LO circuit 187 is also shown which permits the operator to select between high and low attachment operating ranges.

In order to initiate a plunge operation, the operator toggles the AUTO-PLUNGE ON/OFF switch 185 to the ON position. In response, the computer 182 instructs the engine 36 to operate at the pre-selected target output level, and further instructs the boom 47 to begin its descent toward the ground. As the excavation implement 51 contacts the ground, the plunge control system and process described hereinabove effectively regulates the plunge operation so as to achieve optimal excavation efficiency during the plunge operation. The operator toggles the AUTO-PLUNGE ON/OFF switch 185 to the OFF position to halt downward movement of the boom 47. When it is desired to raise the boom 47, the operator toggles the BOOM UP/DOWN switch 183 to the UP position, which results in raising of the boom 47 above the ground surface. A detailed wiring diagram of a boom control switch 181 is illustrated in FIG. 14.

It will, of course, be understood that various modifications and additions can be made to the preferred embodiments discussed hereinabove without departing from the scope or spirit of the present invention. Accordingly, the scope of the present invention should not be limited by the particular embodiments discussed above, but should be defined only by the claims set forth below and equivalents thereof.

What is claimed is:

1. A system for controlling an excavation attachment coupled to an excavation machine having an engine, the system comprising:

a boom pivotally mounted to the excavation machine and supporting an endless digging chain;

a cylinder, coupled to the excavation machine and the boom, that moves the boom between a ground-level position and a below-ground position;

a controllable valves, coupled to the cylinder, that regulates displacement of the cylinder to modify a rate of boom movement; and a controller that controls the controllable valve to modify the rate of boom movement so as to maintain the engine at a target output level as the boom is moved between the ground-level and below-ground positions.

2. The system of claim 1, wherein:

the engine comprises a sensor that senses engine speed; and the controller controls the controllable valve to modify the rate of boom movement in response to sensed engine speed.

3. The system of claim 1, wherein the controller controls the controllable valve to modify the rate of boom movement to maintain the engine at the target output level indicative of maximum engine horsepower.

4. The system of claim 1, further comprising:

a motor coupled to a pump and the endless digging chain;

a pressure sensor and a flow rate sensor that respectively sense a pressure and a flow rate of fluid through the motor; and wherein the controller controls the controllable valve to modify the rate of boom movement in response to the pressure and flow rate respectively sensed by the pressure and flow rate sensors.

5. The system of claim 1, further comprising a motor that drives the endless digging chain and a sensor coupled to the motor, wherein the controller controls the controllable valve to modify the rate of boom movement in response to sensed motor output.

6. The system of claim 1, wherein the controllable valve comprises any of an open center valve, a closed center valve, a load sense valve, or a proportional directional valve.

7. The system of claim 1, wherein the controller controls the controllable valve using a current control signal.

8. The system of claim 1, wherein the controller controls the controllable valve such that a change in engine output level varies proportionally with a change in control current supplied to the controllable valve.

9. The system of claim 1, wherein the controller controls the controllable valve using a pulse width modulated control signal.

10. The system of claim 1, wherein the controller controls the controllable valve using either a digital control signal or an analog control signal.

11. The system of claim 1, further comprising a display that displays an informational message indicative of engine operation or digging chain operation.

12. A system for controlling an excavation implement of an excavation machine while excavating earth between a ground-level position and a below-ground position, the system comprising:

a boom supporting the excavation implement and movably coupled to the excavation machine;

an actuator coupled to the boom and the excavation machine that moves the boom and the excavation implement between the ground-level and below-ground positions; and a computer coupled to the actuator and an engine provided on the excavation machine that modifies actuation of the actuator to maintain the engine at a target operating level in response to variations in engine loading as the excavation implement is moved between the ground-level and below-ground positions.

13. A method for controlling an excavation implement between an ground-level position and a below-ground position, the excavation implement being coupled to an excavation machine having an engine, the method including the steps of:

actuating the excavation implement by use of the engine operating at a target output level;

excavating earth between the ground-level position and the below-ground position;

sensing, while excavating earth, a performance parameter indicative of either engine performance or excavation implement performance; and modifying actuation of the excavation implement in response to the performance parameter to maintain the engine at the target output level when the engine is subject to variations in loading as the excavation implement moves between the ground-level and below-ground positions.

14. The method of claim 13, including the step of displaying an informational message indicative of the performance parameter.

15. The method of claim 13, wherein the sensing step includes the step of sensing a performance parameter indicative of either engine speed or engine horsepower.

16. The method of claim 13, wherein the modifying step includes the step of comparing the sensed performance parameter to a target performance parameter.

17. A method for controlling an earth penetrating member between a ground-level position and a below-ground position, the method including the steps of:

actuating the earth penetrating member to dislodge earth in contact with the earth penetrating member;

moving, by use of a motive power source operating at a target operating level, the earth penetrating member between the ground-level position and the below-ground position; and modifying movement of the earth penetrating member to maintain the motive power source at the target operating level in response to variations in motive power source loading as the earth penetrating member is moved between the ground-level and below-ground positions.

* * * * *